US011845523B2

(12) United States Patent
Gulliksson et al.

(10) Patent No.: US 11,845,523 B2
(45) Date of Patent: Dec. 19, 2023

(54) ENGINE CONTROL

(71) Applicant: CPAC SYSTEMS AB, Gothenburg (SE)

(72) Inventors: Erik Gulliksson, Gothenburg (SE); Mathias Lindeborg, Gothenburg (SE)

(73) Assignee: CPAC SYSTEMS AB, Gothenburg (SE)

( * ) Notice: Subject to any disclaimer, the term of this patent is extended or adjusted under 35 U.S.C. 154(b) by 536 days.

(21) Appl. No.: 16/981,423

(22) PCT Filed: May 8, 2018

(86) PCT No.: PCT/EP2018/061897

§ 371 (c)(1),
(2) Date: Sep. 16, 2020

(87) PCT Pub. No.: WO2019/214811

PCT Pub. Date: Nov. 14, 2019

(65) Prior Publication Data

US 2021/0070413 A1 Mar. 11, 2021

(51) Int. Cl.
*B63B 13/00* (2006.01)
*B63H 21/21* (2006.01)
(Continued)

(52) U.S. Cl.
CPC ..... *B63H 21/21* (2013.01); *B63B 13/00* (2013.01); *B63B 34/00* (2020.02); *B63B 79/10* (2020.01);
(Continued)

(58) Field of Classification Search
CPC ..... B63H 21/21; B63H 21/14; B63H 21/17; B63H 25/00; B63H 2021/216; B63B 79/40; B63B 79/10; B63B 34/00; B63B 13/00
See application file for complete search history.

(56) References Cited

U.S. PATENT DOCUMENTS 5,142,473 A 8/1992 Davis
5,263,432 A 11/1993 Davis
(Continued)

FOREIGN PATENT DOCUMENTS

CA 2974575 A1 2/2018
CN 102050216 A 5/2011
(Continued)

OTHER PUBLICATIONS

International Preliminary Report on Patentability dated Jul. 22, 2020 in corresponding International PCT Application No. PCT/EP2018/061897, 13 pages.
(Continued)

*Primary Examiner* — Mathew Franklin Gordon
(74) *Attorney, Agent, or Firm* — Venable LLP; Jeffri A. Kaminski

(57) ABSTRACT

A method for controlling a propulsion operation of a propulsion unit to reach a desired speed of a marine vessel. The method comprises obtaining a target speed configuration indicating the desired speed of the marine vessel, obtaining a current speed value associated with a current speed of the marine vessel, obtaining a fill level value associated with a fill level of one or more ballast tanks of the marine vessel, and controlling the propulsion operation of the propulsion unit to reach the desired speed based on the target speed configuration, the current speed value, and on the fill level value.

12 Claims, 5 Drawing Sheets

(51) Int. Cl.

| | |
|---|---|
| ***B63B 79/40*** | (2020.01) |
| ***B63B 79/10*** | (2020.01) |
| ***B63H 21/14*** | (2006.01) |
| ***B63H 21/17*** | (2006.01) |
| ***B63H 25/00*** | (2006.01) |
| ***B63B 34/00*** | (2020.01) |

(52) U.S. Cl.
CPC ..... *B63B 79/40* (2020.01); *B63H 21/14* (2013.01); *B63H 21/17* (2013.01); *B63H 25/00* (2013.01); *B63H 2021/216* (2013.01)

(56) References Cited

U.S. PATENT DOCUMENTS

| | | | |
|---|---|---|---|
| 7,361,067 | B1 | 4/2008 | Smedema |
| 8,145,372 | B2 | 3/2012 | Walse et al. |
| 8,798,825 | B1 | 8/2014 | Hartman |
| 9,068,855 | B1 | 6/2015 | Guglielmo |
| 2004/0029459 | A1 | 2/2004 | Berthiaume et al. |
| 2010/0240266 | A1 | 9/2010 | Shibayama et al. |
| 2012/0191277 | A1 | 7/2012 | Clever et al. |
| 2016/0266580 | A1 | 9/2016 | Okamoto et al. |
| 2018/0037305 | A1 | 2/2018 | Sheedy et al. |

FOREIGN PATENT DOCUMENTS

| | | | |
|---|---|---|---|
| CN | 103124965 | A | 5/2013 |
| DE | 4340747 | C1 | 4/1995 |
| EP | 2778038 | A2 | 9/2014 |

OTHER PUBLICATIONS

International Search Report and Written Opinion dated Jan. 9, 2019 in corresponding International PCT Application No. PCT/EP2018/061897, 9 pages.

Chinese Office Action dated Aug. 4, 2023 in corresponding Chinese Patent Application No. 201880092257.0 (8 pages).

ENGINE CONTROL

CROSS-REFERENCE TO RELATED APPLICATIONS

This application is a U.S. National Stage application of PCT/EP2018/061897, filed May 8, 2018, and published on Nov. 14, 2019, as WO 2019/214811 A1, all of which is hereby incorporated by reference in its entirety.

TECHNICAL FIELD

This disclosure relates to control of propulsion units, such as combustion engines and electric motors, used to power marine vessels such as leisure craft boats.

BACKGROUND

When operating marine vessels, it is sometimes desired to configure a speed of the marine vessel which is to be reached and maintained automatically by a speed control function. Speed control functions based on the global positioning system (GPS) are known. A user inputs a desired speed to the system, and an automatic speed control unit then compares the desired speed to a current speed of the boat using speed data obtained from the GPS system. The control unit then controls a propulsion operation of the boat to reach and maintain the desired speed by adjusting current speed to match the desired speed.

Speed control functions are particularly useful when implemented in power boats used for wake sports such as wakeboarding, wakesurfing, wakeskating, and kneeboarding, where a constant speed, or auto-pilot, operation is often desired.

U.S. Pat. No. 5,142,473 A discloses a speed, acceleration, and trim control system for power boats.

U.S. Pat. No. 8,145,372 B2 discloses a watercraft speed control device.

Consistent acceleration performance and propulsion characteristics are desired in a marine vessel. It can be difficult to obtain such consistency when using a speed control function optimized for a single operating scenario, since operating conditions may change.

It may be a problem to base control of propulsion units on signals internal to the propulsion unit, since it may be costly to connect such internal signals to a control unit external to the propulsion unit. Also, the control system then needs to be adapted to different types of propulsion systems which can be time consuming and costly.

SUMMARY

It is an object of the present disclosure to provide methods and control units for improved propulsion control of propulsion units for marine vessels.

This object is obtained by a method for controlling a propulsion operation of a propulsion unit 110 to reach a desired speed V of a marine vessel 100. The method comprises obtaining a target speed configuration indicating the desired speed V, obtaining a current speed value associated with a current speed of the marine vessel, and also obtaining a fill level value associated with a fill level of one or more ballast tanks of the marine vessel. The method also comprises controlling the propulsion operation of the propulsion unit to reach the desired speed based on the target speed configuration, the current speed value, and on the fill level value.

Thus, the control operation is not only based on target speed and current speed as in known methods for speed control, but also on the fill level value of the ballast tanks. This way the control operation is compensated for changed vessel dynamics due to filling and emptying of the ballast tanks. This provides for a more consistent acceleration performance of the vessel during launch, and also for a more rapid acceleration when the vessel is heavily loaded to generate a large wake. The use of the method for controlling propulsion in various water sports activities is especially advantageous due to the improved propulsion operation. A further advantage is that the compensation is achieved without accessing internal functions of a particular propulsion unit 110. For instance, a control method based on measuring, e.g., changes in load of a combustion engine will not work directly with an electric motor drive, but will require modification and adaptation, which can be costly and time consuming. This method based on ballast tank fill level circumvents such problems. Yet another advantage relates to a shortened settling time of the vessel speed during launch, due to the compensating for ballast tank fill levels.

According to aspects, the method comprises obtaining a power trim setting associated with the propulsion unit and controlling the propulsion operation of the propulsion unit to reach the desired speed based also on the power trim setting.

The use of power trim to generate large wakes also changes dynamical properties of the vessel. The improved control methods disclosed herein are applicable also for different power trim settings, which is an advantage.

According to aspects, the propulsion unit comprises any of a combustion engine, an electrical motor, or a hybrid electric motor and combustion engine arrangement. Thus, the disclosed control methods are applicable for a wide range of different propulsion units in that the improved control is based on sensor signals obtained independently from the propulsion unit.

The object is also obtained by a method for controlling a propulsion operation of a propulsion unit to reach a desired speed V of a marine vessel. The method comprises obtaining a target speed configuration indicating the desired speed V of the marine vessel, obtaining a current speed value associated with a current speed of the marine vessel, obtaining a power trim setting associated with the propulsion unit, and controlling the propulsion operation of the propulsion unit to reach the desired speed based on the target speed configuration, the current speed value, and on the power trim setting.

This method is also associated with the advantages mentioned above.

There are furthermore disclosed herein propulsion arrangements, marine vessels, and control units associated with the above-mentioned advantages.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The inventive concept is now described, by way of example, with reference to the accompanying drawings, in which.

DETAILED DESCRIPTION

The inventive concept will now be described more fully hereinafter with reference to the accompanying drawings, in which certain embodiments of the inventive concept are shown. This inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art.

Figure 1:
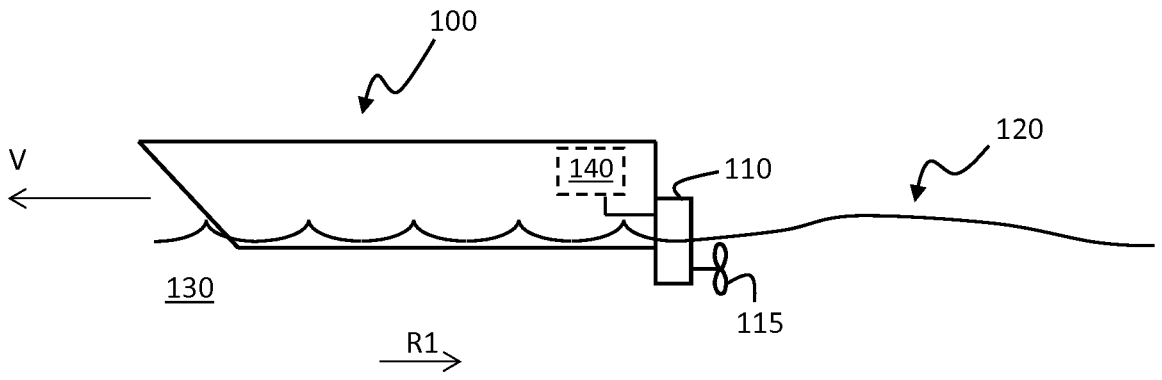
FIGS. 1-2 schematically illustrate marine vessels.

FIG. 1 schematically illustrates a marine vessel 100 moving through water 130. The marine vessel may, e.g., be a power boat used for wake sports, i.e. a smaller boat or leisure craft. The vessel moves through the water 130 using a propulsion unit 110. The propulsion unit 110 illustrated in FIG. 1 is an example propulsion unit comprising a propeller 115. However, it is appreciated that the techniques disclosed herein are applicable also to other types of propulsion units, such as pump-jets, hydrojets, or water jet propulsion units. The vessel 100 moves through the water 130 at a desired speed V. When moving through the water a resistive force R1 acts on the hull of the vessel. Power boats are often constructed using planing hulls. A planing hull is designed to reduce the resistive force R1 by lifting the vessel out of the water. Planing hulls are known and will not be discussed in detail here.

The vessel 100 comprises a control unit 140 arranged to control a propulsion operation of the propulsion unit 110 to reach and to maintain the desired speed V. The control unit 140 is arranged to obtain a target speed configuration from user input or from memory indicating the desired speed, and also a current speed of the marine vessel. The control unit 140 controls the propulsion unit 110 based on a difference between the desired speed and the current speed. I.e., if the current speed is below the desired speed then the propulsion power is increased in order to increase the current speed, and if the desired speed is below the current speed then the propulsion power is decreased in order to decrease the current speed down to a level close to the desired speed.

The target speed configuration may be obtained in a number of different ways, e.g., by a user operating a throttle lever, or by a user inputting a target speed value using an input device such as a key-pad or touch-screen, or by accessing memory to load a stored target speed configuration.

The vessel generates a wake 120 when travelling through the water. It is usually desired to minimize this wake, since a large wake may be detrimental to performance of the vessel in terms of, e.g., fuel consumption and acceleration performance.

The control unit 140 provides automatic speed control based on the target speed and on the current speed. This automatic speed control is usually calibrated for a normal operating condition, i.e., normal propulsion of the vessel with a normal sized wake 120. The calibration often involves different power control settings as a function of the difference between target speed and current speed, and also based on current speed alone, in order to achieve a comfortable yet rapid acceleration during launch of the vessel.

Figure 2:
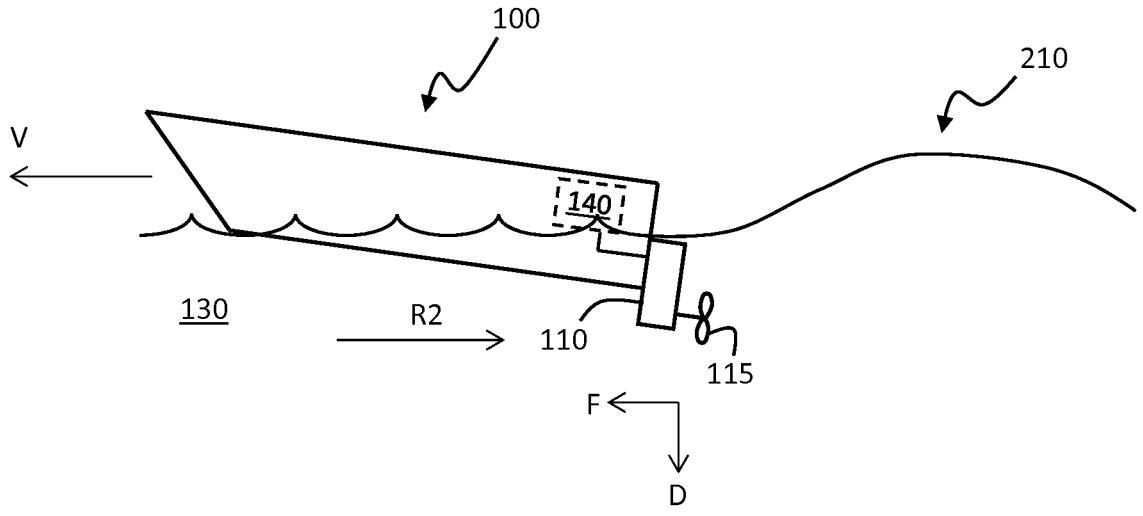

FIG. 2 schematically illustrates a marine vessel 100 deliberately arranged to generate a large wake 210. This large wake is suitable for water sports such as wakeboarding, wakesurfing, wakeskating, and kneeboarding, where a person uses the wake during the water sport activity.

The large wake operation may be obtained, e.g., by using ballast tanks or by adjusting a power trim setting of the propulsion unit. By filling ballast tanks arranged on the vessel, the weight of the vessel increases which lowers the vessel deeper into the water. Ballast tanks will be discussed in detail in connection to FIG. 3 below. The power trim setting of a propulsion unit determines an angle of thrust of the propulsion unit with respect to a forward extension direction of the hull. The power trim of a propulsion unit can be arranged at a variable downward thrust level, e.g., between −5 to +6 degrees, or between −5 and +30 degrees, which downward thrust level will lower the stern section of the vessel deeper into the water and thus generate a larger wake. A downward thrust direction D and a forward thrust direction F are illustrated in FIG. 2. It is appreciated that the relationship between downward D and forward F thrust operation affects the position of the vessel stern section with respect to a water level line.

A problem associated with operating the marine vessel 100 to generate the large wake 210 is that the physical properties, or dynamical properties, of the vessel 100 changes substantially. For instance, the resistive force R2 acting on the hull increases significantly compared to R1. This means that, if the control unit 140 is optimized for the scenario illustrated in FIG. 1, where the wake is not so large, then a sub-optimal operation can be expected when using the speed control in the scenario illustrated in FIG. 2. For instance, acceleration performance of the vessel will differ. Also, there is a risk that the current speed will overshoot the desired speed when accelerating due to the increased inertia of the vessel and propulsion unit system in FIG. 2 compared to FIG. 1.

The methods and control units disclosed herein aim at compensating for the changed behavior of the vessel 100 when it is being used to deliberately generate a large wake, such as in FIG. 2. The control unit 140 is arranged to obtain a target speed configuration indicating the desired speed V of the marine vessel 100 and to also obtain a current speed value associated with a current speed of the marine vessel 100. These two values, or equivalently the difference between them, allow the control unit to control propulsion to reach the desired speed. However, to account for increased resistivity in some operating scenarios, the control unit 140 is also arranged to obtain a fill level value associated with a fill level of one or more ballast tanks of the marine vessel 100, and to control the propulsion operation of the propulsion unit 110 to reach the desired speed V based on the target speed configuration, the current speed value, and on the fill level value. This way the control unit is able to compensate for the changed dynamical behavior of the boat when one or more ballast tanks have been used to deliberately generate a large wake. For instance, an output power of the propulsion unit can be increased in dependence of the ballast tank fill level to account for the increased resistivity R2.

A user will, due to the actions of the control unit 140, experience a more consistent acceleration performance of the vessel during different operating conditions, which is an advantage. The user will also experience a more rapid and accurate acceleration to reach a desired speed when a large wake is generated, which is an advantage. Furthermore, overshoots in excess of the desired speed during launch can now be more easily avoided since the control unit is able to account for the additional inertia due to increased ballast tank fill levels.

According to an example, the present disclosure relates to a speed control function that allows a driver of the vessel 100 to set a desired target speed of the vessel and then by, e.g., just pushing a control lever to 'high' throttle instruct a control unit to control a propulsion unit in order to reach the target speed without overshooting the target speed. The control unit uses information of power trim angle and/or ballast tank level in the vessel to compensate the speed control function.

The disclosed technique aims to achieve sufficient acceleration and a shortened settling time of the speed during launch using the information of power trim angle and/or ballast tank level to compensate the speed controller as the water resistivity is larger when the ballast tanks are filled, and/or the power trim angle is large.

Figure 3A:
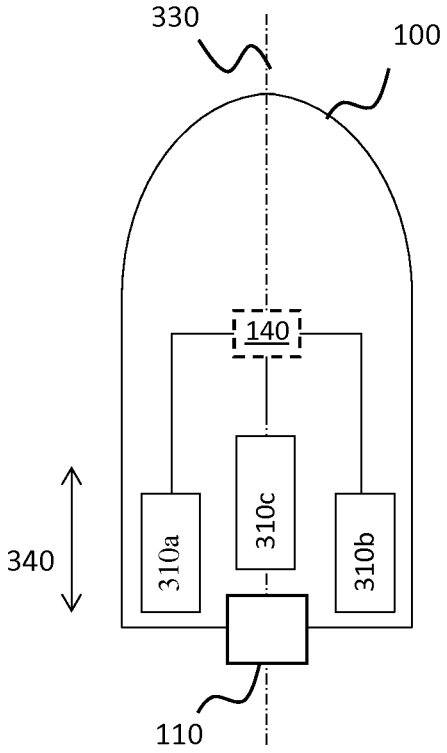
FIGS. 3*a*,3*b* show ballast tank arrangements.
Figure 3B:
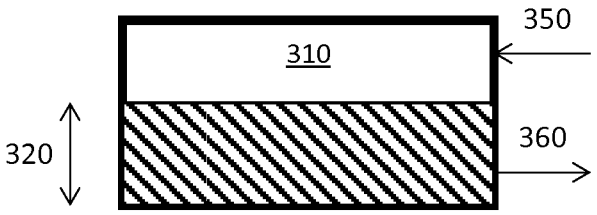

FIGS. 3*a* and 3*b* show ballast tank arrangements. As mentioned above, ballast tanks may be used to change the position of the hull of the vessel 100 in the water. By filling ballast tanks, the weight of the vessel increases which means that the vessel will sit lower in the water. Pumps can be used to fill and to empty the ballast tanks. Ballast tank arrangements are known and will not be discussed in more detail here.

FIG. 3*a* illustrates an example ballast tank configuration comprising three ballast tanks 310*a*, 310*b*, and 310*c*. There are two ballast tanks arranged at the sides of the hull, and one ballast tank arranged in the middle of the vessel 100 relative to a center line 330 of the hull. The ballast tanks may be arranged in connection to a stern section 340 of the vessel 100. Thus, by filling the ballast tanks the stern of the vessel is lowered into the water which will generate a larger wake.

FIG. 3*b* illustrates a ballast tank 310 filled up to a fill level 320 of the ballast tank. This fill level can be measured either directly by using tank level sensors such as floatation devices, or indirectly by measuring the amount of liquid entering and leaving the ballast tank using flow sensors arranged on intakes 350 and drains 360 of the ballast tank 310.

The control unit 140 shown in FIG. 3*a* is operatively connected to obtain a fill level value associated with a fill level 320 of the one or more ballast tanks 310*a*, 310*b*, 310*c* of the marine vessel 100. According to aspects, the control unit is arranged to receive sensor signals from the tank level sensors and/or from the flow sensors, from which the control unit can determine the fill level of each ballast tank individually, or a total fill level of all ballast tanks, or an average fill level of the ballast tanks. This way, the control unit 140 is arranged to obtain a fill level value associated with a fill level 320 of one or more ballast tanks 310*a*, 310*b*, 310*c* of the marine vessel 100.

Power trim arrangements are known and will not be discussed in more detail here. The current state of the power trim, i.e., the power trim setting, can be obtained using feedback signals from the power trim arrangement.

Figure 4:
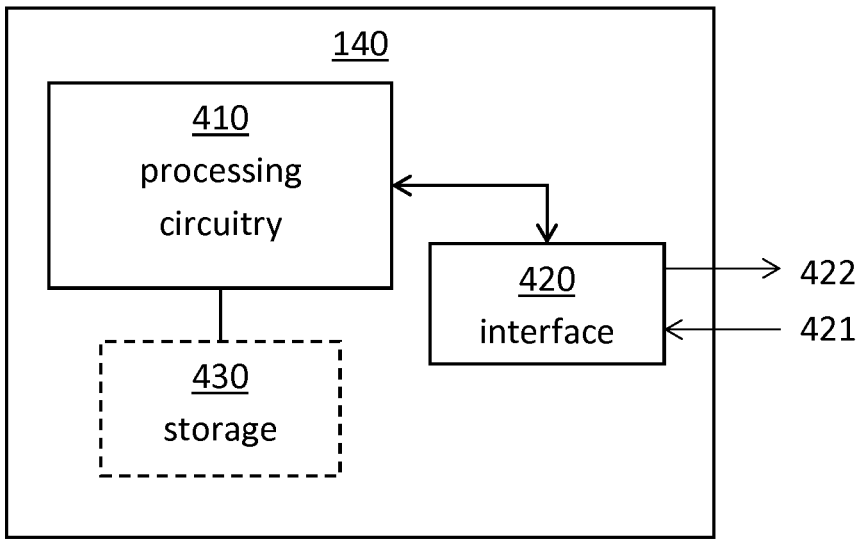
FIG. 4 schematically illustrates a control unit.

FIG. 4 schematically illustrates an example of the control unit 140. The control unit 140 is arranged to control a propulsion operation of a propulsion unit 110 to reach a desired speed V of a marine vessel 100. The control unit 140 comprises processing circuitry 410 configured to obtain a target speed configuration indicating the desired speed V of the marine vessel 100, to obtain a current speed value associated with a current speed of the marine vessel 100, and also to obtain a fill level value associated with a fill level 320 of one or more ballast tanks 310*a*, 310*b*, 310*c* of the marine vessel 100. The control unit 140 also comprises an interface module 420, which interface module is arranged to receive input signals 421 from external sensors and to output control signals 422 to, e.g., systems for operating the propulsion unit 110.

The input signals 421 comprise target speed configuration, which target speed configuration may, e.g., be indicated by a user operating a throttle lever or inputting a target speed using a keyboard or touch-screen or be retrieved from memory 430.

The input signals 421 also comprise the current speed value of the vessel 100. The current speed value is the speed at which the vessel moves through the water, or, alternatively, over ground. A speed over ground input signal may, e.g., be obtained from a GPS or other satellite-based or cellular-based positioning system, or from a sonar sensor arrangement and the like. A speed through water input signal may be obtained from, e.g., a log or from a pitometer arrangement.

It is appreciated that the current speed value of the vessel and the target speed configuration can be replaced in a straight forward and equivalent manner by a difference signal indicating an error in speed, i.e., a difference between target speed and current speed.

The input signals 421 furthermore comprise the fill level value or comprise data from which the fill level value can be inferred. Sensor signals related to a fill level value associated with a fill level 320 of one or more ballast tanks were discussed above in connection to FIGS. 3*a* and 3*b*.

The processing circuitry 410 is arranged to receive the input signals 421 via the interface module 420 and to control the propulsion operation of the propulsion unit 110 to reach the desired speed V based on the target speed configuration, the current speed value, and on the fill level value.

According to some aspects, the processing circuitry is also arranged to maintain the desired speed V based on the target speed configuration, the current speed value, and on the fill level value.

Examples of how the processing circuitry is arranged to perform the control will be discussed below in connection to FIG. 10. However, in general, the processing circuitry implements a control algorithm based on the input signals and generates one or more output signals which realizes the control of the propulsion operation.

The control unit 140 comprises an optional storage medium 430 for storing a set of operations. The processing circuitry 410 is then configured to retrieve the set of operations from the storage medium to cause the control unit 140 to perform a set of operations as discussed herein. In particular, the control unit is arranged to execute the methods discussed below in connection to FIG. 10.

There is also disclosed herein a computer program for controlling a propulsion operation of a propulsion unit 110 to reach a desired speed V of a marine vessel 100. The computer program comprises computer code which, when run on processing circuitry 410 of a control unit 140, causes the control unit 140 to obtain a target speed configuration indicating the desired speed of the marine vessel, obtain a current speed value associated with a current speed of the marine vessel, obtain a fill level value associated with a fill level of one or more ballast tanks of the marine vessel, and to control the propulsion operation of the propulsion unit to reach the desired speed based on the target speed configuration, the current speed value, and on the fill level value.

There is furthermore disclosed herein a computer program product comprising a computer program according to the above, and a computer readable means on which the computer program is stored.

According to some aspects, the processing circuitry 410 is configured to increase a propulsion power of the propulsion unit 110 in dependence of the fill level value. This means that the control unit monitors the fill level, and if the fill level increases then the control unit also increases the propulsion power of the propulsion unit 110 to account for the added resistivity R2. Consequently, a more consistent acceleration performance is obtained, and also a faster acceleration up to the desired speed, as well as a reduced settling time. Furthermore, these advantages are obtained without accessing any internal data signals in the propulsion unit 110, such as load or torque. The control unit is therefore independent of the type of propulsion unit used and can be operated together with different types of propulsion units without significant modification, which is an advantage.

According to some other aspects, the processing circuitry 410 is configured to obtain a power trim setting associated with the propulsion unit 110, and to control the propulsion operation of the propulsion unit 110 to reach the desired speed V based also on the power trim setting. As discussed above in connection to FIG. 2, power trim may be changed in order to divert forward thrust F into a downward thrust D. This downward thrust level acts on the stern section of the vessel to lower the stern section into the water, thus generating a larger wake. The downward thrust level generates an increased resistive force R2 compared to a resistive force R1 when downward thrust is not increased. To account for an increased downward thrust level, the processing circuitry is, according to some aspects, configured to increase a propulsion power of the propulsion unit 110 in dependence of a power trim downward thrust level associated with the power trim setting. As mentioned above, the increasing of propulsion power can be achieved by outputting suitable control signals 422 via the interface module 420.

It is appreciated that the control operations of the control unit 140 and of the processing circuitry 410 related to control based on ballast tank fill level and on power trim setting are independent albeit combinable control actions. Thus, control can be performed based on either of these input signals or based on a combination of both input signals.

The processing circuitry 410 is provided using any combination of one or more of a suitable central processing unit CPU, multiprocessor, microcontroller, digital signal processor DSP, etc., capable of executing software instructions stored in a computer program product, e.g. in the form of a storage medium 430. The processing circuitry 410 may further be provided as at least one application specific integrated circuit ASIC, or field programmable gate array FPGA, or programmable integrated circuit PIC.

Particularly, the processing circuitry 410 is configured to cause the control unit 140 to perform a set of operations, or steps. For example, the storage medium 430 may store the set of operations, and the processing circuitry 410 may be configured to retrieve the set of operations from the storage medium 430 to cause the control unit 140 to perform the set of operations. The set of operations may be provided as a set of executable instructions. Thus, the processing circuitry 410 is thereby arranged to execute methods as herein disclosed, such as the methods discussed below in connection to FIG. 10.

The storage medium 430 may also comprise persistent storage, which, for example, can be any single one or combination of magnetic memory, optical memory, solid state memory or even remotely mounted memory.

The control unit 140 comprises an interface module 420 for communications with at least one external port and/or sensor device. As such the interface module 420 may comprise one or more transmitters and receivers, comprising analogue and digital components and a suitable number ports for wireline or wireless communication.

The processing circuitry 410 controls the general operation of the control unit 140 e.g. by sending data and control signals to the interface module 420 and the storage medium 430, by receiving data and reports from the interface module 420, and by retrieving data and instructions from the storage medium 430. Other components, as well as the related functionality, of the control unit 140 are omitted in order not to obscure the concepts presented herein.

According to aspects, the storage medium 430 comprises vessel profiles and/or user profiles which can be configured in order to allow for different control characteristics based on different hull types and the like. Also, a user may configure the control mechanism for personalization. I.e., some users may want to have a more aggressive acceleration compared to other users. Consequently, according to some aspects, the control unit is arranged to control the propulsion operation of the propulsion unit to reach the desired speed also based a type of the marine vessel type. This way the speed control system can be optimized based on, e.g., hull type and on how the dynamical properties of the vessel changes when ballast tanks are full compared to when ballast tanks are not filled. Thus, advantageously, a more refined control method is obtained leading to a more consistent acceleration performance over different operating scenarios of the propulsion unit 110.

Figure 5:
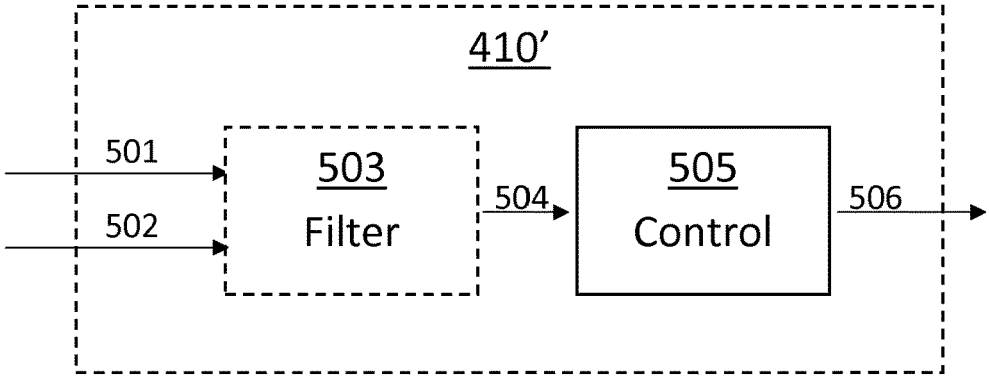
FIG. 5 illustrates an example processing circuitry.

FIG. 5 illustrates an example of a generic processing circuitry 410' according to the present teaching. The processing circuitry 410' is arranged to obtain input signals 501, 502, and to output control signals 506 to a propulsion unit 110. The input signal 501 comprises a difference between target speed configuration and current speed value, i.e., an indication of if the vessel 100 is moving too fast or too slow through the water or over ground relative to the desired speed V. The input signal 502 comprises a fill level value, and/or a power trim setting. An optional filter 503 is first applied in order to reduce measurement noise and distortion in the input signals.

The filter 503 is, according to some aspects, a Kalman filter configured with a motion model of the vessel, which motion model is parameterized by the fill level value. The filtered input signals 504 are input to a control algorithm which generates an output control signal 506 for controlling propulsion operation of the propulsion unit 110 to reach a desired speed V. It is appreciated that a large variety of different filters and control algorithms may be applied in order to reach the intended effect of reaching the desired speed while compensating for a varying resistive force R2 acting on the vessel due to changes in ballast tank fill level and/or power trim setting.

Figure 6:
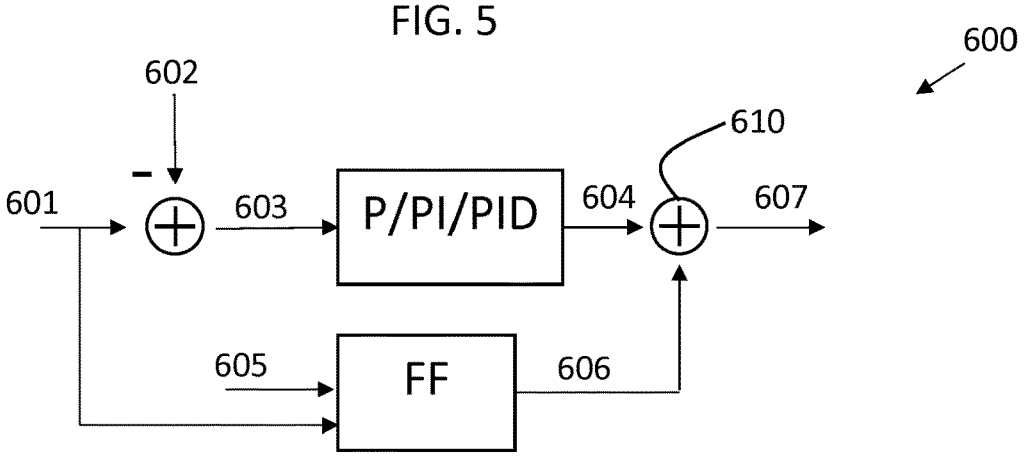
FIG. 6 illustrates an example control device.

FIG. 6 illustrates an example of a control device 600, such as the control device 505 shown in FIG. 5. Here a difference 603 between the target speed configuration 602 and the current speed value 601 is first determined. This difference 603 constitutes an error signal which it is desired to minimize or at least to bound within a range of acceptable error. The error signal is input to a control algorithm based on any of a proportional, P, a proportional-integral, PI, or a proportional-integral-derivative, PID, regulator. It is appreciated that possible regulators are not limited to P, PI, or PID regulators, more advanced regulators may of course also be applied. The control algorithm generates an output signal 604. However, this output signal does not account for variation in resistivity due to, e.g., ballast tank fill level or power trim setting. The control algorithm therefore comprises a feedforward term, FF, or a biasing term. This biasing takes the fill level value or power trim setting as input signal 605. A mapping function is then applied by multiplying the input signal 605 by a factor, FF factor, determined in dependence of the current speed to generate the bias value 606. This bias value is then added to the output signal 604 from the control algorithm to generate a biased output signal 607 which can be used for controlling the propulsion operation of the propulsion unit 110. The mapping function determines the impact of the biasing. This mapping function can be determined by computer simulation or by practical experiments, and it can be linear or non-linear.

Figure 7:
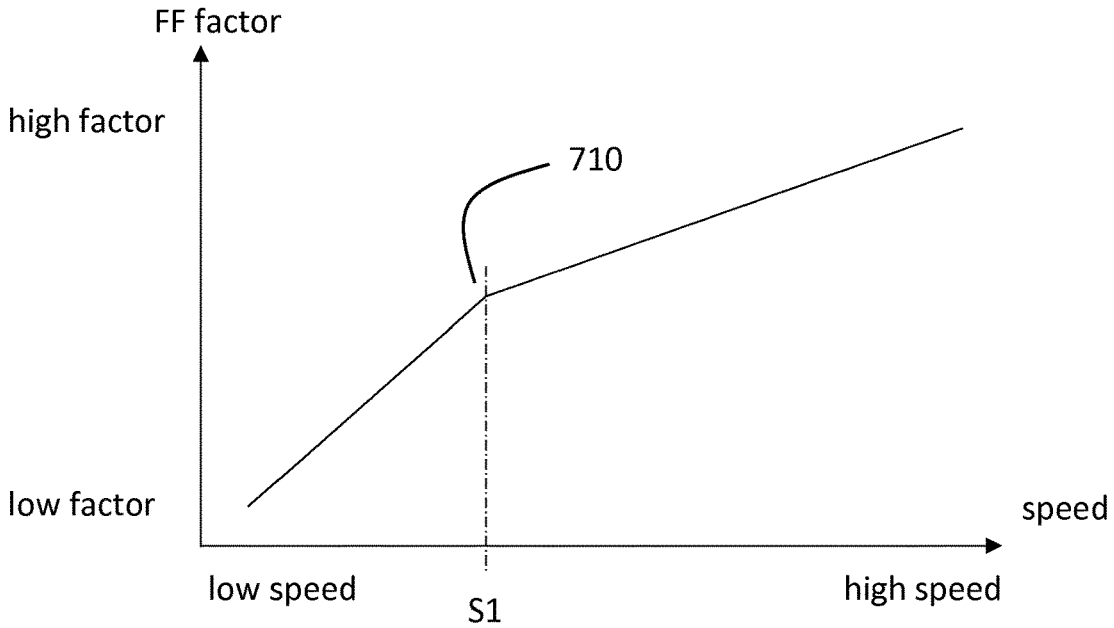
FIG. 7 is a graph exemplifying a feedforward factor in dependence of boat speed.

An example of the mapping function is a linear mapping function such as that illustrated in FIG. 7. Here, the mapping function starts at a zero or small multiplication factor, FF factor, and increases linearly up to a boat speed breakpoint 710, where a second linear function is used with a smaller increase as function of boat speed. The breakpoint is, according to some aspects, configured at a boat speed S1 of 8 knots.

Figure 8:
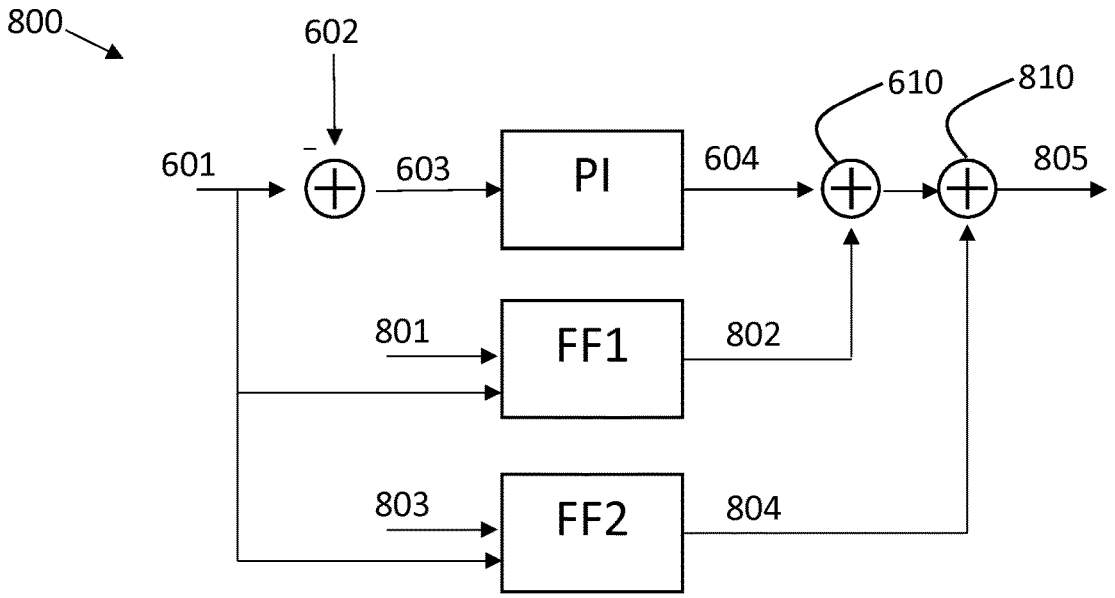
FIG. 8 illustrates an example control device.
Figure 9:
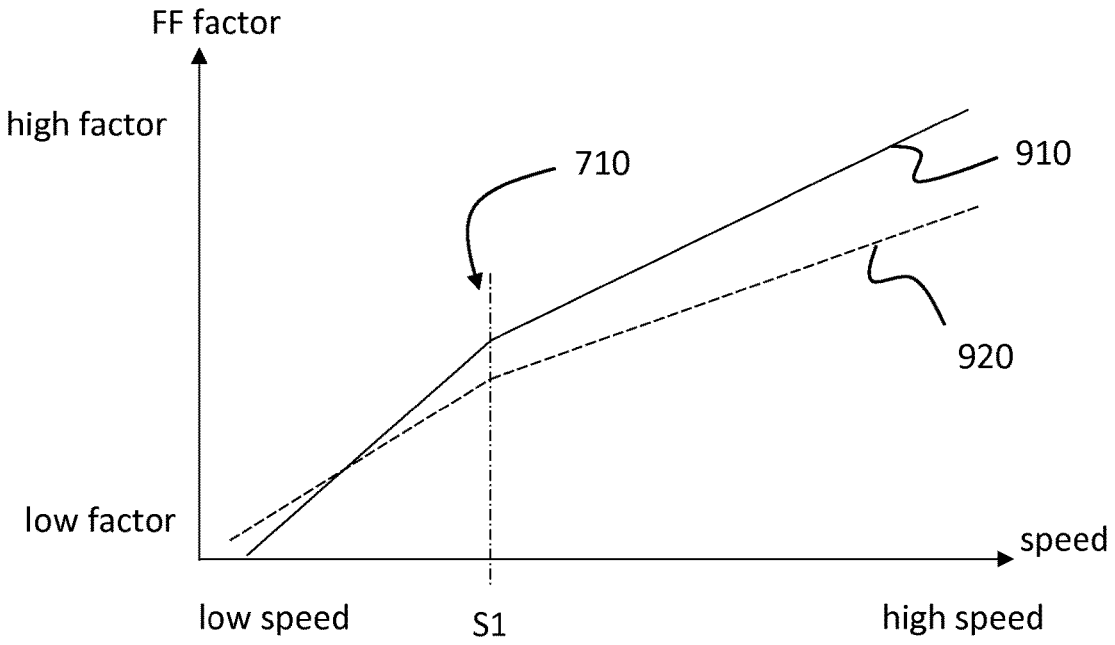
FIG. 9 is a graph exemplifying feedforward factors in dependence of boat speed.

FIG. 8 illustrates another example of a control device 800. This control device uses both ballast tank fill level value 801 and power trim setting 803 to bias the output of the control algorithm. The biasing is achieved by using two separate feedforward terms similar to the feedforward term discussed above in connection to FIG. 7. Each feedforward term is obtained by multiplying the current speed 601 by a factor obtained from a mapping function 910, 920. It is appreciated that the mapping functions can be different for the two feedforward factors as illustrated in FIG. 9. An example of linear mapping functions is illustrated in FIG. 9, although non-linear mapping functions can also be used.

Thus, FIGS. 6 and 8 illustrate watersport speed controllers comprising standard PI controllers with inputs comprising a target speed configured, e.g., by a user and also a current speed of the vessel. The output of the controller is a control signal such as a throttle in a range of 0-100%, where 0% is idle throttle and 100% is wide open throttle (WOT). There is also a feed forward term within the controller which is represented by a mapping or function between current speed and throttle bias to achieve a fixed output of the controller with limited noise in the speed control signal. To compensate for a large water resistance, the information of ballast tank fill levels and power trim angle is used as an offset to this feed forward term, optionally alongside with a minor change of the proportional part of the PI controller. The offset of the feedforward term is related to the water level 0-100% in the ballast tanks. The power trim angle between −5 to +6 degrees, or between −5 and +30 degrees, can also be used to compensate the output of the control algorithm.

As an alternative, or in addition to the biasing, the control algorithm parameters may be adjusted based on the ballast tank level and/or based on the power trim setting. For instance, when a P or PI controller is used, then the proportional gain factor and or the gain factor associated with the integrating may be adjusted based on the ballast tank fill level. Consequently, a larger gain in the control loop is obtained when the ballast tanks are filled compared to when they are empty. This yields a more decisive control action when resistive forces are larger, leading to a more consistent acceleration performance.

Figure 10:
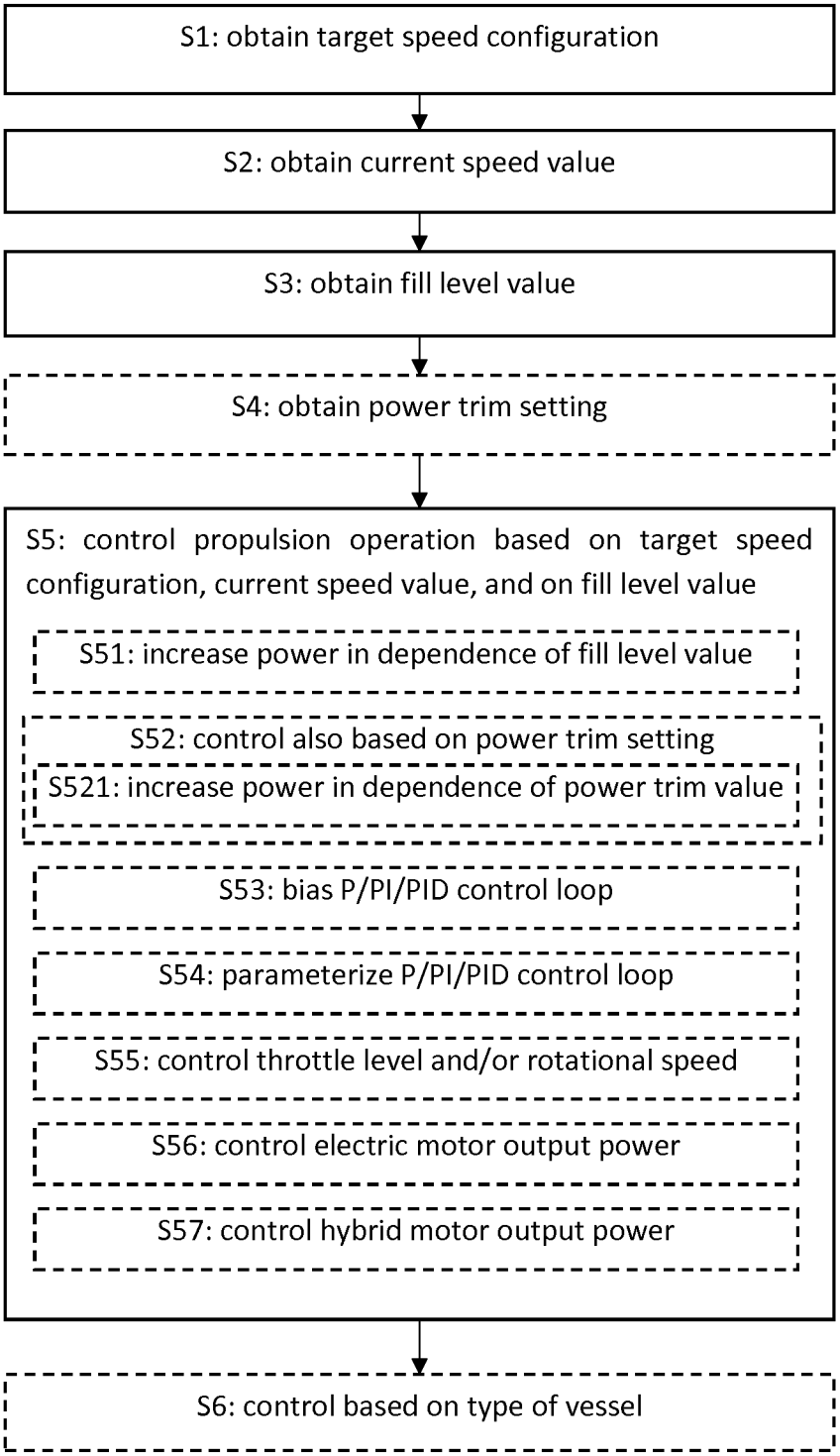
FIG. 10 is a flow chart showing methods.

FIG. 10 is a flow chart showing methods according to the discussion above. In particular, there is illustrated a method for controlling a propulsion operation of a propulsion unit 110 to reach a desired speed V of a marine vessel 100. The method comprises obtaining S1 a target speed configuration indicating the desired speed V of the marine vessel 100, obtaining S2 a current speed value associated with a current speed of the marine vessel 100, and also obtaining S3 a fill level value associated with a fill level 320 of one or more ballast tanks 310*a*, 310*b*, 310*c* of the marine vessel 100. The method further comprises controlling S5 the propulsion operation of the propulsion unit 110 to reach the desired speed based on the target speed configuration, the current speed value, and on the fill level value.

As mentioned above, the control based on ballast tank fill level and control based on power trim setting can be performed separate from each other or jointly. Consequently, there is also disclosed herein a method for controlling a propulsion operation of a propulsion unit 110 to reach a desired speed V of a marine vessel 100. The method comprises obtaining a target speed configuration indicating the desired speed V of the marine vessel 100, obtaining a current speed value associated with a current speed of the marine vessel 100, and obtaining a power trim setting associated with the propulsion unit 110. The method further comprises controlling S5 the propulsion operation of the propulsion unit 110 to reach the desired speed based on the target speed configuration, the current speed value, and on the power trim setting.

Differently from known marine vessel speed control systems, the disclosed methods perform control based on fill level of ballast tanks, and/or based on trim setting. This has the effect of compensating for changes in dynamical behavior of the vessel 100 due to different fill levels and power trim settings. An increased resistivity R2 due to deliberately generating a large wake is compensated for by the control based on fill level of ballast tanks, and/or based on trim setting. Thus, advantageously, a user experiences a more consistent acceleration performance of the vessel between different operating scenarios, reduced overshoot when reaching the desired speed, and also faster acceleration when using the vessel for watersports involving deliberately generating large wakes.

According to aspects, the controlling comprises increasing S51 a propulsion power of the propulsion unit in dependence of the fill level value. This means that the propulsion power is increased when fill level value is increased, leading to a more consistent acceleration performance in that more power is used when resistivity is large compared to when resistivity is small.

According to aspects, the method comprises obtaining S4 a power trim setting associated with the propulsion unit 110 and controlling S52 the propulsion operation of the propulsion unit to reach the desired speed V based also on the power trim setting.

According to aspects, the controlling comprises increasing S521 a propulsion power of the propulsion unit in dependence of a power trim downward thrust level associated with the power trim setting. This means that the propulsion power is increased when downward thrust level is increased, again leading to a more consistent acceleration performance.

According to aspects, the controlling comprises using S53 any of a proportional, P, a proportional-integral, PI, or a proportional-integral-derivative, PID, control loop configured to minimize a difference between the target speed configuration and the current speed value, wherein an output control signal 607, 803 of the P, PI, or PID control loop is biased 610, 810 in dependence of the fill level value and/or in dependence of the power trim setting. The use of P, PI, or PID controllers was discussed and exemplified in connection to FIGS. 6-9 above. P, PI, and PID controllers present attractive design alternatives in that they are well known, easy to simulate using computer simulation, of low complexity, and also easy to implement.

According to aspects, the controlling comprises using S54 any of a proportional, P, a proportional-integral, PI, or a proportional-integral-derivative, PID, control loop configured to minimize a difference between the target speed configuration and the current speed value, wherein the P, PI, or PID control loop is parameterized in dependence of the fill level value and/or in dependence of the power trim setting. To parameterize a control loop means that the parameters are adjusted based on an input signal. In this case, for a P, PI, or PID controller, the gain parameter is adjusted in dependence of, e.g., the tank fill level, such that a larger gain is obtained when the tanks are full compared to when the tanks are empty. This way the changes in dynamical behavior are automatically compensated for.

According to aspects, the propulsion unit 110 comprises a combustion engine, and controlling the propulsion operation comprises controlling S55 a throttle level and/or a rotational speed and/or a torque associated with the combustion engine.

According to aspects, the propulsion unit 110 comprises an electric motor, and controlling the propulsion operation comprises controlling S56 an output power of the electric motor.

It is an advantage that the disclosed control methods and control units do not rely on signals internal to the propulsion unit, such as engine load measurements or estimates of engine torque. The power trim setting and the ballast tank fill level signals are independent of the particular type of propulsion unit used, i.e., combustion engine, electric motor, water-jet, etc.

According to aspects, the method comprises controlling S6 the propulsion operation of the propulsion unit to reach the desired speed also based a pre-configured type of the marine vessel and/or based on a pre-configured user profile. This way the speed control system can be optimized based on, e.g., hull type and on how the dynamical properties of the vessel changes when ballast tanks are full compared to when ballast tanks are not filled. Thus, advantageously, a more refined control method is obtained leading to a more consistent acceleration performance over different operating scenarios of the propulsion unit 110.

The invention claimed is:

1. A method for controlling a propulsion operation of a propulsion unit to reach a desired speed of a marine vessel upon acceleration, the method comprising obtaining a target speed configuration indicating the desired speed, obtaining a current speed value associated with a current speed of the marine vessel, obtaining a fill level value associated with a fill level of one or more ballast tanks of the marine vessel, and controlling the propulsion operation of the propulsion unit to reach the desired speed based on the target speed configuration, the current speed value, and on the fill level value, characterized in that if the fill level value is increasing then also increasing the propulsion power of the propulsion unit to account for added resistivity.

2. The method according to claim 1, comprising obtaining a power trim setting associated with the propulsion unit, and controlling the propulsion operation of the propulsion unit to reach the desired speed based also on the power trim setting.

3. The method according to claim 2, wherein the controlling comprises increasing a propulsion power of the propulsion unit in dependence of a power trim downward thrust level associated with the power trim setting.

4. The method according to claim 1, wherein the controlling comprises using any of a proportional, P, a proportional-integral, PI, or a proportional-integral-derivative, PID, control loop configured to minimize a difference between the target speed configuration and the current speed value, wherein an output control signal of the P, PI, or PID control loop is biased in dependence of the fill level value and/or in dependence of the power trim setting.

5. The method according to claim 1, wherein the controlling comprises using any of a proportional, P, a proportional-integral, PI, or a proportional-integral-derivative, PID, control loop configured to minimize a difference between the target speed configuration and the current speed value, wherein the P, PI, or PID control loop is parameterized in dependence of the fill level value and/or in dependence of the power trim setting.

6. The method according to claim 1, wherein the propulsion unit comprises a combustion engine, and wherein controlling the propulsion operation comprises controlling a throttle level and/or a rotational speed and/or a torque associated with the combustion engine.

7. The method according to claim 1, wherein the propulsion unit comprises an electric motor, and wherein controlling the propulsion operation comprises controlling an output power of the electric motor.

8. The method according to claim 1, comprising controlling the propulsion operation of the propulsion unit to reach the desired speed also based on a pre-configured type of the marine vessel and/or based on a pre-configured user profile.

9. A control unit arranged to control a propulsion operation of a propulsion unit to reach a desired speed of a marine vessel upon acceleration, the control unit comprising processing circuitry, the processing circuitry being configured to obtain a target speed configuration indicating the desired speed of the marine vessel, and to obtain a current speed value associated with a current speed of the marine vessel, the processing circuitry is configured to obtain a fill level value associated with a fill level of one or more ballast tanks of the marine vessel, and to control the propulsion operation of the propulsion unit to reach the desired speed based on the target speed configuration, the current speed value, and on the fill level value, characterized in that the control unit is arranged to increase the propulsion power of the propulsion unit if the fill level value increases in order to account for added resistivity.

10. The control unit according to claim 9, wherein the processing circuitry is configured to obtain a power trim setting associated with the propulsion unit, and to control the propulsion operation of the propulsion unit to reach the desired speed based also on the power trim setting.

11. The control unit according to claim 10, wherein the processing circuitry is configured to increase a propulsion power of the propulsion unit in dependence of a power trim downward thrust level associated with the power trim setting.

12. A propulsion arrangement for a marine vessel comprising a propulsion unit and the control unit according to claim 9.

* * * * *